United States Patent [19]

Hales

[11] Patent Number: 4,463,226

[45] Date of Patent: Jul. 31, 1984

[54] TIMING DEVICE DRIVING MEANS

[76] Inventor: Paul D. Hales, P.O. Box 7573, High Point, N.C. 27264

[21] Appl. No.: 449,541

[22] Filed: Dec. 13, 1982

[51] Int. Cl.[3] ..... H01H 7/00; H01H 43/00

[52] U.S. Cl. ..... 200/35 R; 200/38 R

[58] Field of Search ..... 200/35, 38, 39

[56] References Cited

U.S. PATENT DOCUMENTS

| | | | |
|---|---|---|---|
| 2,868,287 | 1/1959 | Estey | 200/35 R |
| 3,123,683 | 3/1964 | Lewis et al. | 200/38 B |
| 3,390,243 | 6/1968 | Obermann | 200/38 B X |
| 3,732,383 | 5/1973 | Voland et al. | 200/38 R |
| 3,819,886 | 6/1974 | Homan et al. | 200/38 B |

*Primary Examiner*—J. R. Scott

[57] ABSTRACT

The present invention demonstrates apparatus to initiate the timing cycle of a cam operated timer which is durable and works in a smooth, even fashion. The apparatus includes a first electric motor having a rotatable shaft, said shaft being joined to a clutch or ratchet assembly. A second electric motor drives the cam operated timer during the timing cycle while the clutch or ratchet assembly allows the first motor to disengage.

15 Claims, 8 Drawing Figures

TIMING DEVICE DRIVING MEANS

BACKGROUND AND OBJECTIVES OF THE INVENTION

Cam operated timing devices as shown in my pending patent application Ser. No. 415,132 now U.S. Pat. No. 4,419,548 demonstrate the use of a plurality of notched cam wheels mounted on a common cam shaft which operate and allow electricity to be supplied to desired appliances or devices for selected periods of time. For example, it may be desirable to activate a home furnace for a four hour period during certain cold days prior to the occupants arriving at the house whereby the house will be warm and ready for their arrival. Thus, by remote means or otherwise as explained in detail in my pending applications Ser. No. 383,538 (U.S. Pat. No. 4,438,295) and Ser. No. 415,132 (U.S. Pat. No. 4,419,548) certain remote control activation devices are shown along with timing devices for various purposes or functions.

It has been found that the initial activation apparatus or driving means of a timing device can be made to operate in a smooth, even manner with less wear and strain on certain parts than as previously shown. For example, the driving means in U.S. application Ser. No. 415,132 (U.S. Pat. No. 4,419,548) demonstrates apparatus which includes an electrical solenoid. While effective, it has been found that the electrical solenoid provides a "jerking action" to the driving means as the timer is activated which requires periodic refinements and adjustments and may not be suitable in all circumstances as too much strain may be placed on particular parts of the timing device.

With these and other disadvantages of the prior driving means for timing devices known, it has been one objective of the present invention to provide a driving means which operates in a smooth, even manner and which provides less wear and strain on the working parts of the driving and timing means.

It is still another objective of the present invention to provide a driving means which is reliable and which is relatively easy to construct and inexpensive to operate.

It is still another objective of the present invention to provide a driving means which will initiate the timing cycle of a cam-operated timer in a smooth, uniform manner and which will be durable over a period of years.

Various other objectives and advantages of the present invention will be understood to those skilled in the art as the examples and illustrations are shown below.

SUMMARY OF THE INVENTION

The present invention provides a variation of a driving means for initiating the timing cycle of a cam operated timer as set forth in detail in U.S. Application Ser. No. 415,132 (U.S. Pat. No. 4,419,548). In operation an electrical current is supplied to a first motor means of the driving means causing rotation of the cam shaft of the timing means and thereafter the driving means disengages and a second motor means continues to drive the cam shaft and timing means during the remainder of the timing cycle. After the timing cycle has been completed the driving means may be reactivated and a second timing cycle begun. The initiation of the timing cycle can be controlled at a remote location or it can be manually started on location as required.

The preferred form of the present invention comprises a first low rpm motor means such as a fractional horsepower electric 110 volt AC motor which may be geared to turn at approximately 60 rpms. The first motor means has its shaft connected through a clutch means and is joined to the cam shaft of the timing apparatus. Electricity is supplied to said first motor means through the activation of a relay or switch means as explained in detail in U.S. application Ser. No. 415,132 (U.S. Pat. No. 4,419,548) and when energized, the first motor means turns, thereby rotating the cam shaft and attached cam means of the timing means whereupon the timing means begins its timing cycle. After the initiation of the timing cycle a second motor means which is also joined to the cam shaft "takes over" the rotation of the cam shaft and electrical energy is no longer supplied to the first motor means by the closing of a relay means or otherwise and the second motor means drives the timer through its selected cycle allowing electricity to flow to an appliance or otherwise for a preselected period. As the second motor means rotates the cam shaft of the timing means, the clutch means of the first motor means allows the shaft of the first motor means to disengage and therefore the first motor means stops rotation during the remainder of the timing cycle.

Also included in the preferred embodiment of the apparatus is a manual setting means which comprises a cam shaft gear means, a setting gear means affixed to a setting gear shaft and a knob means rotatably positioned on said setting gear shaft. The user can grasp the knob means (prior to activation of the timing means) and the attached index means engages a setting ratchet means on the setting gear shaft and by rotating the knob means in a counterclockwise direction, the setting gear means rotates the cam shaft gear means thereby turning the cam shaft to position the attached cam means to a desired cycle setting. The setting ratchet means prevents rotation in the wrong or undesired direction.

DETAILED DESCRIPTION OF THE DRAWINGS

For a more in-depth review of the driving means of the present invention as set forth herein, and for a description of other embodiments of the driving means, turning now to the drawings:

FIG. 1 is a schematic perspective view of the preferred embodiment of the driving means of the present invention;

FIG. 2 demonstrates yet another embodiment of the driving means of the present invention;

FIG. 3 shows a bridle cam means positioned to turn a ratchet means;

FIG. 4 demonstrates a cross-sectional view of the knob means as shown in FIGS. 1 and 2;

DESCRIPTION OF THE PREFERRED EMBODIMENTS

Figure 5:
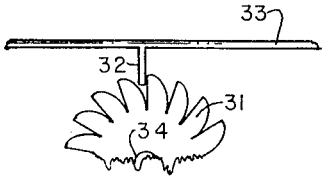
FIG. 5 shows ratchet contact means engaging a ratchet means shown in cut-away fashion.

For a more detailed description of the invention, the driving means of the present invention is for initiating the movement of cam means of a typical cam operated timing means as explained in more detail in my pending application Ser. No. 415,132 (U.S. Pat. No. 4,419,548). Electrical energy from a relay (not shown) flows to a first motor means 11 as shown with cam driving means 10 schematically in FIG. 1. Electrical energy supplied to first motor means 11 causes cam shaft 12 to rotate thus driving cam means 13 positioned thereon. The rotation of cam means 13 allows electricity to flow (by closing a switch means which is not shown) to second motor means 14 which starts and continues the rotation of cam means 13 during the selected time cycle. As would be understood the flow of electricity to first motor means 11 is terminated with the impetus for cam means 13 thereafter provided by second motor means 14. Clutch means 15 associated with first motor means 11 and clutch means 16 associated with second motor means 14 allows cam shaft 12 to freely rotate with the respective motor means being disengaged as required. For example, during the initial rotation of cam shaft 12 by first motor means 11, clutch means 16 disengages motor means 14 and upon electrical energy being supplied to motor means 14, cam shaft 12 is turned by motor means 14 and clutch means 15 then disengages first motor means 11 from cam shaft 12.

Figure 8:
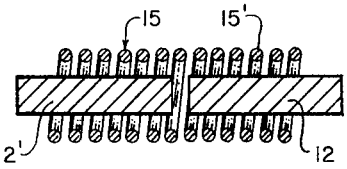
FIG. 8 illustrates a cross-sectional view of the clutch means as shown in FIG. 1.

Clutch means 15 and 16 comprise a coil spring tightly wrapped on the motor shaft means and cam shaft in the direction of the rotation of the respective motor shaft means as shown in detail in FIG. 8. As the motor means 11 turns, coil spring 15' is tightened on cam shaft 12, thus causing cam shaft 12 to rotate with motor shaft 12'. Also, when cam shaft 12 turns by the distant or other motor means 14 attached thereto, coil spring 15' is loosened as the turning force tends to "unwrap" coil spring 15' and therefore motor means shaft 12' will not be forced to turn.

Figure 4:
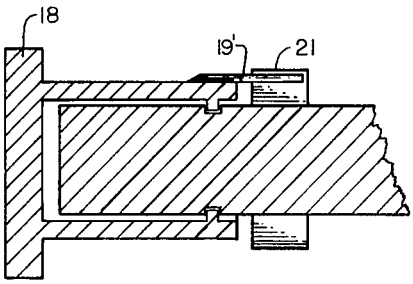
Figure 1:
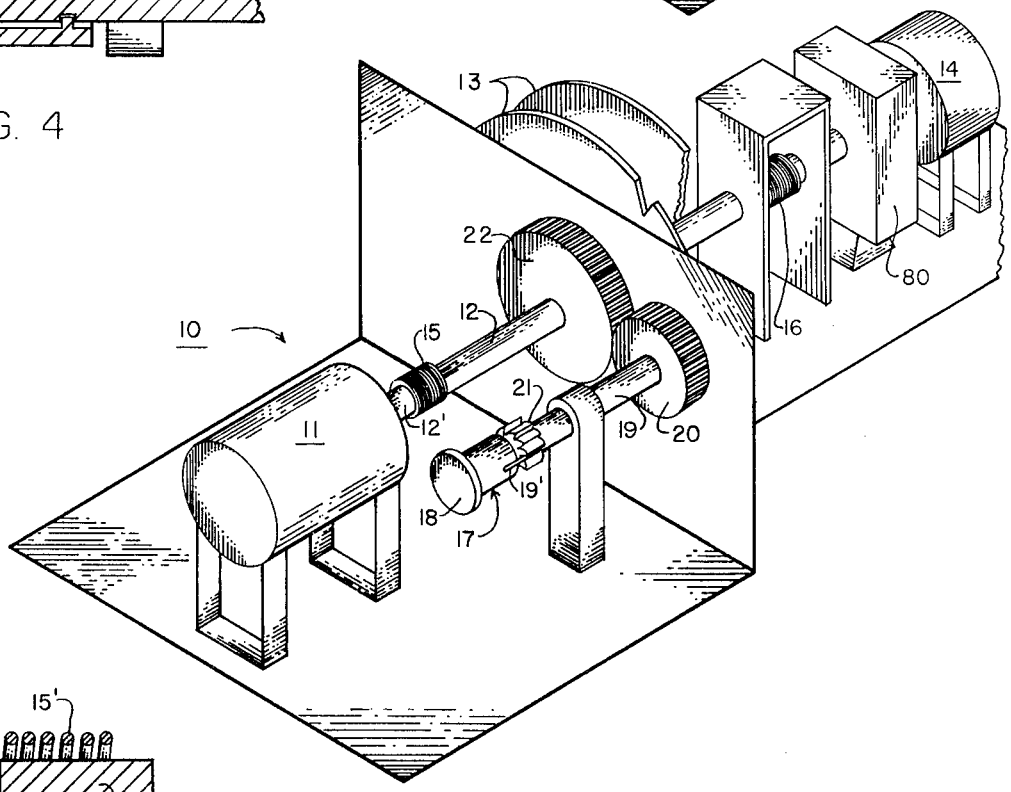

Also shown in FIG. 1 is manual setting means 17 which includes knob means 18, setting gear shaft 19, setting gear means 20 and ratchet means 21. Knob means 18 includes index means 19' which engages ratchet means 21 as shown in more detail in FIG. 4. As would be understood from the drawing as shown in FIG. 4, knob means 18 cooperatively engages ratchet means 21 for rotation of setting gear shaft 19 in a counter-clockwise direction as shown in FIG. 1. The rotation of setting gear shaft 19 in a clockwise direction causes the rotation of setting gear means 20 also in a clockwise direction whereby the engagement of setting gear means 20 and cam shaft gear means 22 causes cam means 13 to rotate in a counter-clockwise direction whereupon said cam means 13 can be manually set in any position as desired. Upon release, knob means 18 is then free to rotate on setting gear shaft 19 as shown in FIG. 4.

As would be further understood, both first and second motor means 11 and 14 as shown in FIG. 1 are relatively low rpm 110 volt AC electric motors which may be gear-reduced to turn at low rpms. Motor means 11 as shown in FIG. 1 is preferrably geared to turn at approximately 60 rpms or slightly higher if required. It has been found that a relatively low rpm first motor means 11 provides a smooth, even initial start of driving means 10. Second motor means 14 is also a low rpm 110 volt AC electric motor rated at 1 revolution per hour and may be geared very low by transmission means 80 to turn cam means 13 at only 1 revolution per 24 hours.

Figure 3:
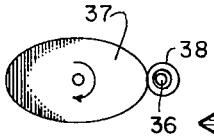
Figure 2:
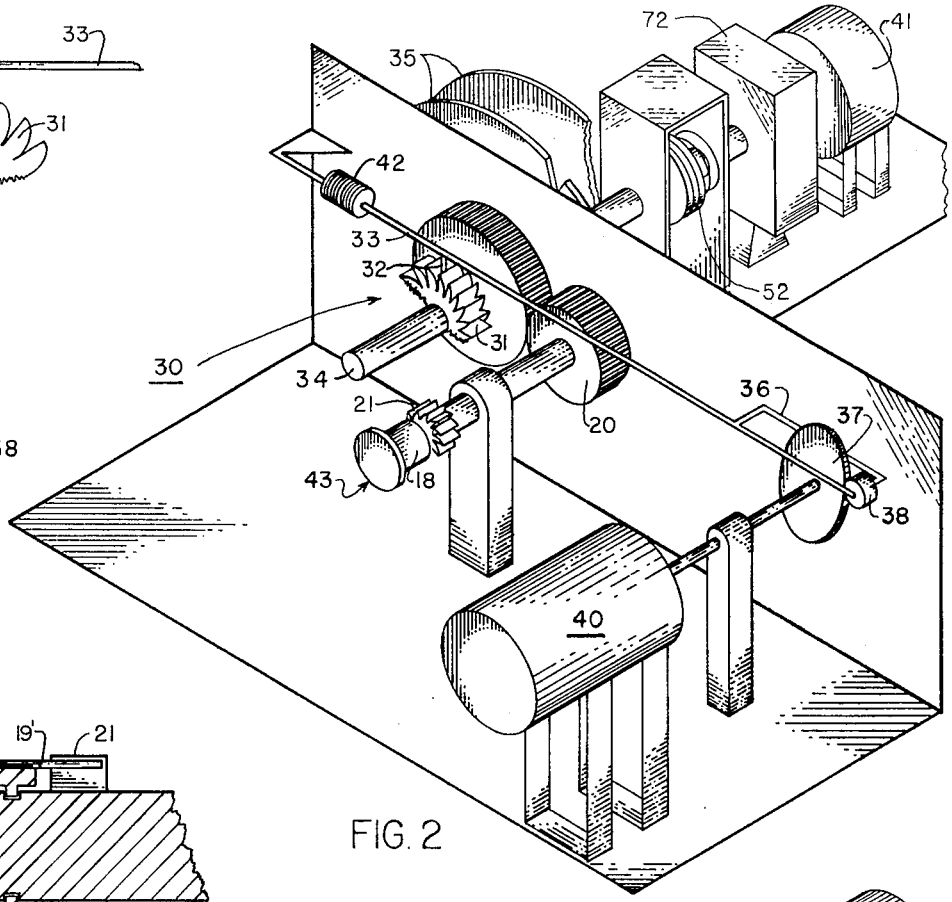

A second embodiment of a driving means is shown in FIG. 2 comprising driving means 30 which includes ratchet means 31, (shown in fragmented fashion), a ratchet contact means 32 positioned on rod means 33 which is slidably positioned proximate ratchet means 31. As rod means 33 moves in a left to right direction as shown in FIG. 2, ratchet contact means 32 engages ratchet means 31 (shown in detail in FIG. 5) and rotates cam shaft 34 upon which cam means 35 are positioned. As further shown in FIG. 2 rod means 33 is urged from left to right as bridle means 36 contacts bridle cam means 37 by the engagement of bridle wheel means 38, as shown in FIG. 3. Bridle cam means 37 is rotated in a clockwise direction as shown in FIG. 3 by the operation of bridle motor means 40.

Electrical energy is supplied to motor means 40 through a relay (not shown) which in turn causes bridle cam means 37 to rotate in a clockwise fashion thus urging rod means 33 from a left to right position. Rod means 33, through ratchet contact means 32 causes cam shaft 34 to rotate thus initially driving cam means 35. Once the initial rotation of cam means 35 has begun, electrical current is no longer supplied to motor means 40 by appropriate switches (not shown) and electrical current is then supplied to cam shaft motor means 41 which may also be 110 volt AC electric motor having a relatively low rpm output of 1 rpm which may be gear reduced by transmission means 72, a conventional gear reduction assembly to 1 revolution per 24 hours. Frictional clutch means 52 as shown will be described in more detail below. Cam shaft motor means 41 drives cam means 35 throughout the duration of the preselected timing cycle. As would further be understood, rod means 33 is returned to its initial position by resilient means 42 which may be a coil spring which is attached to rod means 33. Driving means 30 as shown in FIG. 2 has a manual setting means 43 as explained in connection with driving means 10 shown in FIG. 1.

As explained above driving means 30 as shown in FIG. 2 only initiates the rotational movement of cam means 35 and as soon as initial rotation commences cam shaft motor means 41 continues driving cam means 35 through the duration of the selected timing cycle by appropriate electrical switching means (not shown).

Figure 6:
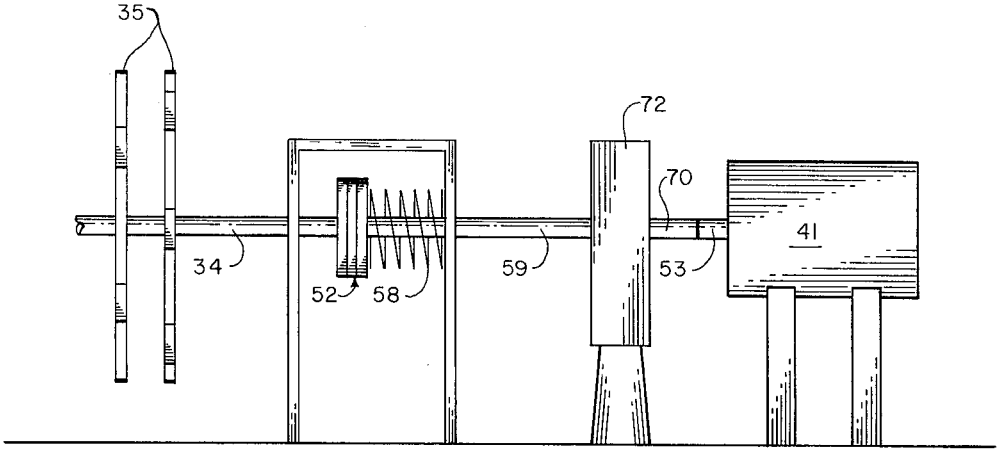
FIG. 6 illustrates in a schematic elevational view of a portion of a cam operated timing device as shown in FIG. 2.

In FIG. 6, motor means 41 drives motor shaft means 53 which is joined to input shaft means 70. As earlier explained transmission means 72 comprises a conventional gear reduction apparatus whereby input shaft 70 rotates at appproximately one revolution per hour whereas output shaft 59 rotates at only one revolution per 24 hours. Output shaft 59 is joined to clutch means 52.

Figure 7:
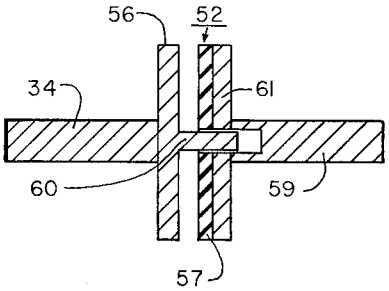
FIG. 7 shows an enlarged cross-sectional view of part of the clutch means as shown in FIG. 6.

FIG. 7 demonstrates in cross-sectional detail the components of clutch means 52 and includes plate 56 which is urged against disc means 57 which may be rubber or some other material having a high frictional coefficient. Disc means 57 is rigidly joined to plate 61, which is connected to output shaft 59. Thus, as resilient member 58 as shown in FIG. 6 urges plate 61 with disc means 57 against plate means 56 the rotation of motor shaft means 53 causes the rotation of cam shaft 34 to which cam means 35 are attached. To insure proper alignment between cam shaft 34 and output shaft 59 axle means 60 slidably engages with shaft means 59 as shown in FIG. 7.

Plate 61 and plate 56 may be metal whereas disc means 57 comprises a material having high frictional characteristic. Thus, cam means 35 can be rotated by hand without motor means 41 turning since a greater amount of rotational force would be required to overcome the torque of motor means 41. In other words, clutch means 52 would slip as cam means 35 are rotated by hand whereas the rotation of motor means 41 would drive cam means 35. Hence, manual setting of cam means 35 can be accomplished as a result of clutch means 52.

The electrical circuitry and other components of the timing means are not shown in the schematic views presented herein as such components are conventional and do not contribute significantly to the invention as shown herein.

Modifications and changes can be made to the examples shown and illustrated and such examples are for explanatory purposes and are not intended to limit the scope of the invention.

I claim:

1. Driving means to initiate the activity of a cam operated timer having rotatable cam means positioned on a cam shaft comprising: a first motor means, said first motor means having motor shaft means, said motor shaft means connected to the cam shaft, a clutch means, said clutch means in cooperative engagement with said first motor shaft means and the cam shaft, a second motor means, said second motor means connected to said cam shaft, said second motor means for rotating said cam shaft during the timing cycle independent of said first motor means, cam switch means, said cam switch means for supplying electrical energy to said second motor means, said cam switch means activated by said first motor means, said clutch means for disengaging said motor shaft means as said second motor means rotates said cam shaft during the timing cycle.

2. Driving means to initiate the timer as claimed in claim 1 wherein said clutch means comprises a coil spring joined to said motor shaft means.

3. Driving means to initiate the activity of a cam operated timer as claimed in claim 1 and including a second clutch means joined to the cam shaft.

4. Driving means to initiate the activity of a cam operated timer as claimed in claim 1 wherein said clutch means comprises a first plate means, said first plate means joined to the cam shaft, second plate means, said second plate means joined to said motor shaft means, frictional disc means, said frictional disc means affixed to said second plate means for engagement with said first plate means.

5. Driving means to initiate the activity of a cam operated timer as claimed in claim 1 and including a second clutch means, said second clutch means positioned on said cam shaft.

6. Driving means as claimed in claim 1 wherein said first motor means is an electric motor having a relatively low rpm range.

7. Driving means as claimed in claim 1 and including a manual setting means, said manual setting means rotatably joined to said cam shaft.

8. Driving means as claimed in claim 7 wherein said manual setting means includes a setting gear means, a cam shaft gear means, said setting gear means meshing with said cam shaft gear means, a setting gear shaft, said setting gear shaft affixed to said setting gear means, knob means, said knob means rotatably positioned on said setting gear shaft, setting ratchet means, said setting ratchet means rigidly affixed to said setting gear shaft, index means, said index means joined to said knob means, said index means for engaging said setting ratchet means whereby rotating said knob means will turn said setting gear means.

9. Driving means as claimed in claim 1 and including a transmission means, said transmission means joined to said second motor means and to the shaft.

10. Driving means to initiate the activity of a cam operated timer having rotatable cam means positioned on a cam shaft comprising: ratchet means, said ratchet means positioned on the cam shaft, rod means, said rod means slidably positioned proximate said ratchet means, ratchet contact means, said ratchet contact means joined to said rod means for engaging said ratchet means, bridle means, said bridle means joined to said rod means, bridle cam means, said bridle cam means rotatably positioned within said bridle means, and bridle motor means, said bridle motor means joined to said bridle cam means for rotating said bridle cam means.

11. Driving means as claimed in claim 10 wherein said bridle motor means comprises a low rpm electric motor.

12. Driving means as claimed in claim 10 and including a manual setting means, said manual setting means rotatably joined to the cam shaft.

13. Driving means as claimed in claim 12 wherein said manual setting means includes a setting gear means, a cam shaft gear means, said setting gear means meshing with said cam gear means, a setting gear shift, said setting gear shaft affixed to said setting gear means, knob means, said knob means rotatably positioned on said setting gear shaft, setting ratchet means, said setting ratchet means rigidly affixed to said setting gear shaft, index means, said index means joined to said knob means, said index means for engaging said setting ratchet means whereby rotating said knob means will turn said setting gear means.

14. Driving means as claimed in claim 10 and including a second motor means, said motor means joined to said cam means.

15. Driving means as claimed in claim 14 wherein said second motor means is connected to a transmission means and said transmission means is joined to the cam shaft.

* * * * *